US005732362A

United States Patent [19]

Izumida et al.

[11] Patent Number: 5,732,362

[45] Date of Patent: Mar. 24, 1998

[54] METHOD FOR TREATING RADIOACTIVE LAUNDRY WASTE WATER

[75] Inventors: Tatsuo Izumida, Hitachinaka; Ryozo Kikkawa; Hiroyuki Tsuchiya, both of Hitachi; Yoshimasa Kiuchi; Yasuo Hattori, both of Hitachinaka, all of Japan

[73] Assignees: Hitachi, Ltd., Tokyo; Hitachi Engineering & Services Co., Ltd.; Hitachi Nuclear Engineering Co., Ltd., both of Ibaraki, all of Japan

[21] Appl. No.: 358,955

[22] Filed: Dec. 19, 1994

[30] Foreign Application Priority Data

Dec. 27, 1993 [JP] Japan ..... 5-330996

[51] Int. Cl.[6] ..... G21F 9/16; G21F 9/08

[52] U.S. Cl. ..... 588/2; 588/20; 588/19; 976/DIG. 351; 976/DIG. 384; 976/DIG. 385

[58] Field of Search ..... 588/19, 20, 2; 976/DIG. 381, DIG. 384, DIG. 385

[56] References Cited

U.S. PATENT DOCUMENTS

| | | | |
|---|---|---|---|
| 4,334,953 | 6/1982 | Sridhar | 159/11 R |
| 4,409,137 | 10/1983 | Mergan et al. | 252/632 |
| 4,432,894 | 2/1984 | Kamiya et al. | 252/632 |
| 4,526,712 | 7/1985 | Hirano et al. | 252/632 |
| 4,559,171 | 12/1985 | Hayashi et al. | 252/629 |
| 4,569,787 | 2/1986 | Horiuchi et al. | 252/632 |
| 4,604,224 | 8/1986 | Cheng | 252/91 |
| 4,664,817 | 5/1987 | Wixon | 252/8.8 |
| 4,693,833 | 9/1987 | Toshikuni et al. | 210/759 |

FOREIGN PATENT DOCUMENTS

| | | |
|---|---|---|
| 56-35837 | 8/1981 | Japan . |
| 63-85498 | 4/1988 | Japan . |

OTHER PUBLICATIONS

Verot, J.L. et al., Study of the Problems posed by the Treatment of Effluents Containing Detergents and Complexing Agents, Nuclear Science Abstracts, 23(6), 9507, 1969.

*Primary Examiner*—Ngoclan Mai

*Attorney, Agent, or Firm*—Fay, Sharpe, Beall, Fagan, Minnich & McKee

[57] ABSTRACT

The present invention relates to a method for treating radioactive laundry waste water generated from a nuclear power plant, nuclear fuel reprocessing plant, or radioactive nuclides handling facilities, and provides a method for treating the waste water safely and for reducing the volume of generated radioactive waste to a minimum.

Radioactive laundry waste water containing a detergent of which major contents are a nonionic surface active agent and inorganic builders is concentrated by an evaporating concentrator, the concentrated waste water is dried and pulverized to dry powder by a rotary centrifugal thin film dryer, and the dry powder is incinerated. By using the above detergent, foaming at the concentration can be reduced, and the concentrated waste water can be easily dried and pulverized. Further, the dried powder can be incinerated stably and safely without influencing undesirable effect on the body of the incinerator.

In accordance with the present invention, laundry waste water can be treated simply and safely, and the final volume of radioactive waste can be reduced to minimum.

12 Claims, 3 Drawing Sheets

METHOD FOR TREATING RADIOACTIVE LAUNDRY WASTE WATER

BACKGROUND OF THE INVENTION (1) Field of the Invention

The present invention relates to a method for treating radioactive laundry waste water, and more particularly to a method for treating radioactive laundry waste water generated at nuclear power plants, nuclear fuel reprocessing plants, and handling facilities for radioactive nuclides.

(2) Description of the Related Art

At nuclear power plants, nuclear fuel reprocessing plants, and handling facilities of radioactive nuclides, working clothes, underwear, shoes, masks and the like for workers in the above facilities are reused after laundering. The laundering methods can be divided roughly into two methods such as water laundering and dry cleaning. In dry cleaning, freon and petroleum group solvents are used, and the solvents are reused after recovering by evaporation. Therefore, dry cleaning generates little laundry waste liquid. However, currently, use of these solvents has gradually come to be restricted in consideration of current environment problems, and conversion to water laundering is being performed.

However, water laundering generates a large amount of waste water which contains radioactive nuclides. Although the amount of the radioactive nuclides is small, it is necessary to eliminate the radioactive nuclides before releasing the waste water.

A method for treating laundry waste water is disclosed in JP-A-56-35837 (1981), wherein foaming at concentrating of the waste water is suppressed and the waste water is heated to dry or to decompose its content. In accordance with the above disclosed method, an antifoamer is added to an evaporator for suppressing foaming at the concentration of the waste water, and a detergent is used which contains no inorganic builder but a nonionic surface active agent which is decomposable by heating, for facilitating thermal decomposition. However, no concrete technical content is disclosed on heating for drying.

A feature of the above method is to use a detergent which does not contain an inorganic builder for facilitating thermal decomposition. Accordingly, the addition of an antifoamer is necessary for suppressing foaming. Further, on account of the lack of any inorganic builder, drying and pulverization of the content are very difficult.

The simplest method for final thermal decomposition is incinerating the content. In order to incinerate, the waste water must be dried out once and, subsequently, the dried residual is treated with an incinerator. However, a detergent containing an organic component as a main constituent has a low melting point, and the above method has difficulty in processing continuously, for drying a large amount of the waste water including the detergent.

Further, a method for treating radioactive waste water containing a surface active agent is disclosed in JP-A-63-85498 (1988), wherein radioactive waste water containing a surface active agent is mixed with waste water containing solid waste and an antifoamer, so that the total amount of the surface active agent and the antifoamer in the mixed waste water becomes more than an amount necessary for defoaming, and at most 8% by weight to an amount of solid waste in the mixed waste water. Subsequently, the mixed waste water is dried and pulverized by heating, and obtained powder is fabricated to pellets. However, the method disclosed in JP-A-63-85498 (1988) has a problem such as increasing the amount of final disposing solid waste, because the fraction of the total amount of the surface active agent and antifoamer to the amount of solid waste is restricted to a relatively small level, such as at most 8% by weight.

SUMMARY OF THE INVENTION (1) Objects of the Invention

An object of the present invention is to provide a method for treating radioactive waste water generated by laundering radioactive contaminated articles with a detergent and water, and more particularly, a method for treating the waste water for reducing its volume and stabilizing it safely.

(2) Methods for Solving the Problem

The present invention is aimed at realizing a method for treating radioactive laundry waste water safely, reducing the generated amount of radioactive waste, and solving the above problem of the conventional method.

That is, in accordance with the present invention, the operation of the concentration is simplified, a large amount of waste water is treated continuously for drying, the dried residual is incinerated simply in an incinerator, and a minimum amount of final waste is obtained. In order to realize the above objects, a problem of foaming at the concentrating process caused by surface active agents in the detergents must be reduced, concentrated liquid obtained by the above concentrating process must be dried and pulverized continuously and simply, and the dried powder obtained by the above drying and pulverizing process must be incinerated and its volume reduced safely in an incinerator.

Foaming caused by the surface active agent can be moderated somewhat by using nonionic surface active agents. In view of continuous drying and pulverizing of the concentrated liquid, the nonionic surface active agent itself is a liquid approximately at room temperature and essentially cannot be pulverized. However, by heating the laundry waste water containing the nonionic surface active agents up to, for instance, about 90 degrees, pulverizing the waste water becomes possible even without inorganic builders. As for incinerating and reducing the volume with the incinerator, it is necessary to prevent undesirable influences such as clogging of the filter in an exhaust gas system of the incinerator. For instance, a problem is generated when incinerated residual is vitrified by melting in a high temperature incinerator.

The above described problems can be solved by using a detergent containing surface active agents, suitable inorganic builders, a small amount of redepositing inhibitors, fluorescent agents, enzymes, and chelating agents, concentrating the laundry waste water containing the above detergent using an evaporating concentrator, pulverizing the concentrated waste water with a rotary centrifugal thin film dryer, and incinerating the obtained powder using an incinerator.

Foaming in the evaporating concentrator can be reduced by adding suitable inorganic builders into the detergent, and the pulverization can be facilitated. Further, in accordance with selecting suitable inorganic builders, melting and vitrification of the incinerated residual in the incinerator can be prevented and undesirable influences in the incinerating facility can be eliminated.

For the drying and the pulverizing process, continuous and stable drying and pulverizing of the concentrated waste water can be achieved by using a rotary centrifugal thin film dryer.

DETAILED DESCRIPTION OF PREFERRED EMBODIMENTS

The operation of the present invention on foaming at the evaporating concentration, drying and pulverizing of the concentrated waste water, and incineration of the residual is explained referring to experimental data hereinafter.

The most serious problem in the evaporating concentration of laundry waste water is foaming of surface active agents in the detergent, which causes migration of a part of the radioactivity in the concentrated waste water into condensed water with foam. Accordingly, foaming at the evaporating concentration must be suppressed as much as possible. Using a nonionic surface active agent can reduce foaming more than using an ionic surface active agent. However, the inventor has found that adding suitable inorganic ion builders enhances the above mentioned effect.

Figure 2:
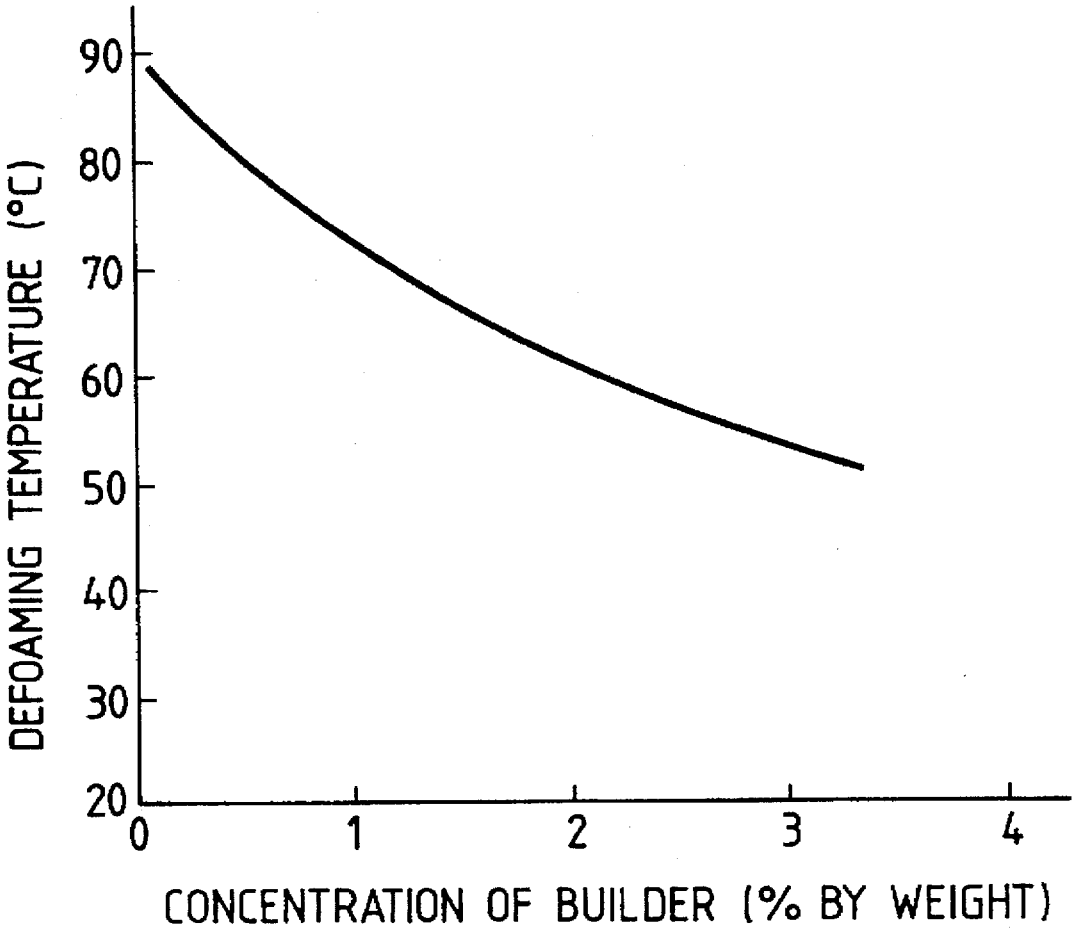
FIG. 2 is a graph illustrating a relationship between defoaming temperature and concentration of builders.

An experimental result is shown in FIG. 2. Nonionic surface active agents can stop foaming at an elevated temperature, and foam is removed at about 90° C. without adding the inorganic builders. The experimental result shown in FIG. 2 reveals that the temperature at which the foam is removed decreases by adding the inorganic builders. Accordingly, foaming can be suppressed by adding the inorganic builders.

For the inorganic builders, any water soluble compound can be used. However, in consideration of subsequent processes, an inorganic builder which can be dried and pulverized with a rotary centrifugal thin film dryer, and which does not melt in the incinerating process, must be selected. Concretely, respective single salts or mixed salts of hydrochloric acid, sulfuric acid, carbonic acid, nitric acid, and aluminosilicic acid are preferable.

A necessary condition for drying and pulverizing the concentrated waste water is that the residual after the evaporating water in the waste water must be solid at room temperature. However, the nonionic surface active agents are liquid at room temperature.

Accordingly, if a main component of the residual is the nonionic surface active agent, the residual cannot be pulverized. In accordance with the present invention, the inventor has found that, if inorganic builders are added to the residual, the detergent containing the nonionic surface active agent can be dried and pulverized. The inorganic builder can be dried and pulverized easily, and the nonionic surface active agent is simultaneously dried and pulverized in an absorbed form by the inorganic builder.

Table 1 indicates an experimental result for investigating the possible melting and vitrification of the residual when incinerating the pulverized powder.

TABLE 1

| Surface active agent | Inorganic Builders | | Causing vitrification | | |
|---|---|---|---|---|---|
| | Zeolite | NaCl | 800° C. | 900° C. | 1000° C. |
| 0.25 | 1 | 0 | no | no | no |
| 0.25 | 1 | 0.5 | no | no | no |
| 0.25 | 1 | 1 | no | no | no |
| 0.25 | 1 | 2 | no | yes | yes |

Remarks: The numerals indicate parts by weight in 100 parts of pulverized powder in total.

In the incinerator, temperature may rise up to about 1000° C. at maximum. Therefore, if the inorganic builder, which is represented by NaCl in the experiment, is more than 1 part by weight in 100 parts by weight of the pulverized powder, the powder causes melting and possibly clogging of filters by spreading the molten powder. Further, the melting of the powder may cause deterioration of the incinerator body.

In order to prevent the vitrification, the most preferable method is to use inorganic builders having a high melting temperature. However, water soluble inorganic builders do not have a very high melting temperature. Therefore, Table 1 indicates an example wherein a mixture of water insoluble Zeolite and water soluble NaCl is used as the inorganic builder. The result shown in Table 1 reveals that vitrification may be caused when the amount of NaCl exceeds a limit. Therefore, it is necessary to control the incinerating temperature in correspondence with the composition of the inorganic builder. However, a region in the composition of the inorganic builder exists wherein the vitrification does not occur even at 1000° C. by controlling adequately an additive amount of the inorganic builder. The region is in a range of the pulverized powder containing the nonionic surface active agent 10–30% by weight and the inorganic builder 60–90% by weight.

In accordance with Table 1, the powder having a composition of 400–800 parts by weight of the inorganic builder to 100 parts by weight of the nonionic surface active agent does not melt even at 1000° C., but the powder having a composition of 1200 parts by weight of the inorganic builder to 100 parts by weight of the nonionic surface active agent melts at 1000° C. Therefore, the maximum allowable mixing ratio of the inorganic builder in view of preventing the vitrification is 800 parts by weight to 100 parts by weight of the nonionic surface active agent.

Further, the minimum mixing ratio of the inorganic builder is decided by a mixing ratio capable of preparing preferable dried powder, as the embodiment 1 which is explained later indicates, to be at least 300 parts by weight to 100 parts by weight of the nonionic surface active agent. Accordingly, a feature of the method for treating radioactive waste water in accordance with the present invention is in providing 300–800 parts by weight of the inorganic builder to 100 parts by weight of the nonionic surface active agent in the radioactive waste water.

When the composition and contents of the detergent in the radioactive laundry waste water are unknown or uncertain owing to mixing or another reason prior to executing a series of the above processing steps such as evaporation and concentration, drying and pulverization, and incineration, the waste water must be analyzed quantitatively for clarifying the contents of the surface active agent and the inorganic builder in the waste water, and the waste water must be adjusted to ensure a preferable mixing ratio of the nonionic surface active agent and the inorganic builder in the waste water prior to the series of processing steps.

The analysis of the waste water is performed by taking a part of the waste water as an analytical sample, and the content of the nonionic surface active agent in the sample is qualitatively determined by conventional methods such as a phosphoric acid tungstate method or cobalt (II) tetrathiocyanate absorptiometry. The content of the inorganic builder is qualitatively determined by a conventional method such as extraction by warm water and ionic chromatography.

When the result of the above qualitative analysis reveals that the ratio of the amount of the inorganic builder to the amount of the nonionic surface active agent is within the range indicated above as a feature of the present invention, the waste water is transferred to the subsequent processing without any treatment.

When the ratio of the amount of the inorganic builder to the amount of the nonionic surface active agent is less than the range indicated above, the waste water is adjusted by adding the inorganic builder to the waste water from a storage tank of the inorganic builder, so that the ratio of the amount of the inorganic builder to the amount of the nonionic surface active agent is within the range indicated above. Subsequently, the waste water is transferred to the next processing stage.

When the ratio of the amount of the inorganic builder to the amount of the nonionic surface active agent is larger than the range indicated above, the waste water is transferred to the subsequent processing stage without any treatment. However, in the incinerating process, the incinerating temperature of the pulverized powder is lowered down to a temperature which does not melt the powder corresponding to the kind and composition of the contained inorganic builder.

In accordance with the present invention, drying, pulverizing, and incinerating of the radioactive laundry waste water, which have been difficult hitherto, can be performed simply and safely. As a result, the radioactive laundry waste water can be reduced in its volume routinely. Further, the obtained powder can be solidified with an inorganic solidifier such as cement or cement glass, and consequently, the radioactive waste water can be disposed safely.

Embodiment 1

Figure 1:
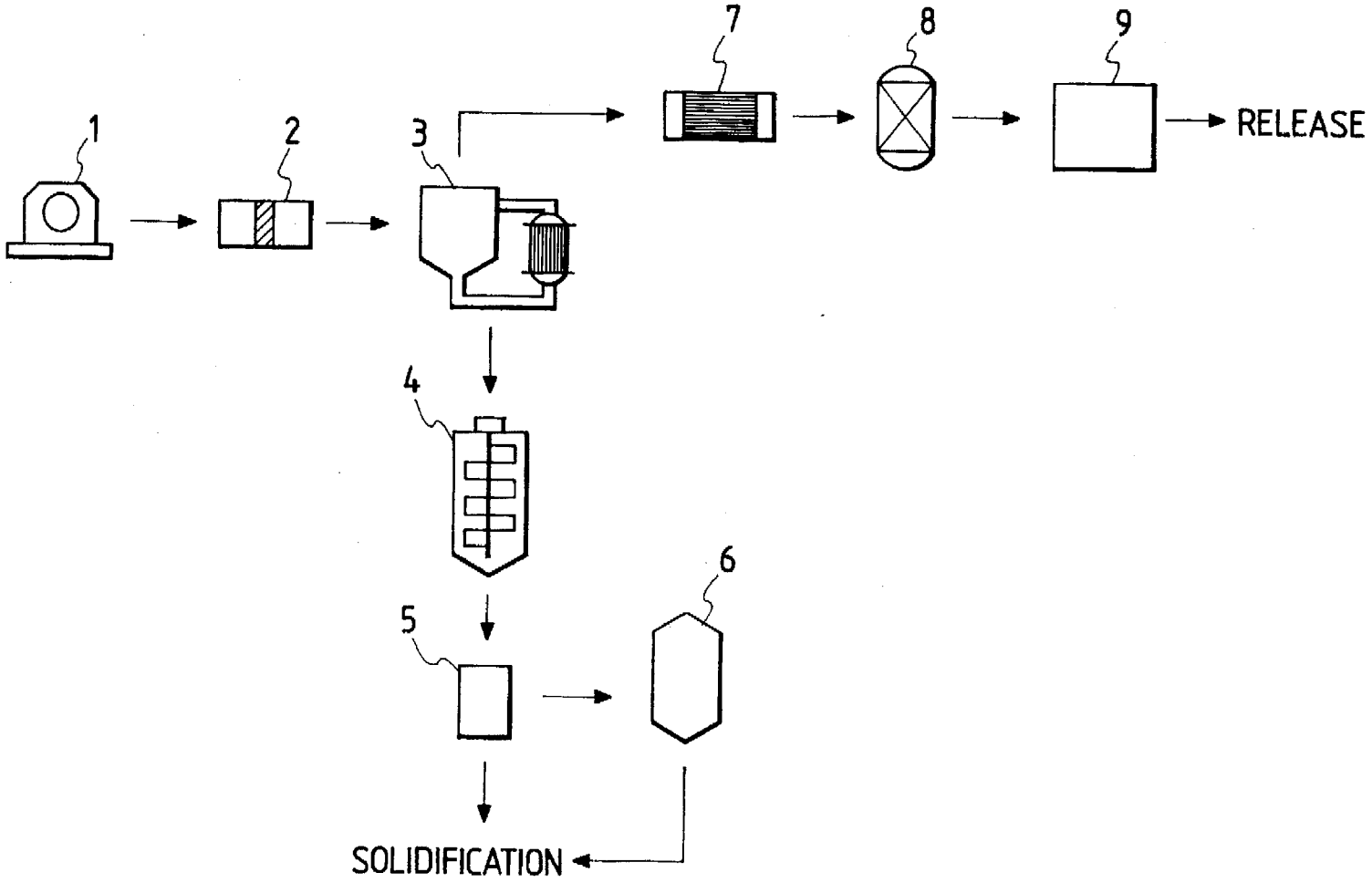
FIG. 1 is a flow diagram illustrating an embodiment of the present invention.

Referring to FIG. 1, an embodiment of the present invention is explained hereinafter.

Laundry waste water exhausted from a washer 1 is transferred to an evaporating concentrator 3 after eliminating coarse insoluble components by filtration 2. At the evaporating concentrator 3, evaporated water is condensed at a heat exchanger 7, cleaned up at an ion exchanger 8, and released after confirmation of its safety by a radiation monitor 9. The released water can be reused.

On the other hand, concentrated water is transferred to a rotary centrifugal thin film dryer 4 and dried and pulverized by heating with a heated inner wall. Dried powder is filled into a powder vessel 5, and transferred for solidification or incineration at an incinerator 6. The incinerated powder is also transferred for solidification after the incinerating process. Table 2 indicates a composition of simulated laundry waste water used in the embodiment.

TABLE 2

| Components | Composition (% by weight) |
|---|---|
| Detergent | 5 |
| NaCl | 2 |
| Insoluble components | 0.5 |
| Inhibitor | 0.5 |

In Table 2, polyoxyethylene derivatives are used as the nonionic surface active agent and sodium chloride is used as the inorganic builder.

The simulated laundry waste water was concentrated by an actual evaporating concentrator, and the concentrated water was dried and pulverized by a rotary centrifugal thin film dryer. Operating conditions of the rotary centrifugal thin film dryer are indicated in Table 3.

TABLE 3

| Items | Operating condition |
|---|---|
| Rotation per minute | 400–500 rpm |
| Heating steam temperature | 130° C. |
| Treating capacity | 60 liter/hour |

In accordance with the operating condition shown in Table 3, dried powder having water content of at most 5% was obtained. A heating temperature higher than 130° C. can be used, but drying with the higher temperature may generate dried powder having a lower water content with an extremely small diameter. Excessively fine powder is not desirable because the powder may cause a problem such as spreading in the air. Therefore, the heating temperature of about 130° C. was most adequate.

The dried powder was filled into a receiving vessel 5 without any trouble such as spreading. The dried powder was incinerated in an incinerator 6. A major component of the residual of the incineration was sodium chloride and its rate of reduction was about 50%. The residual of the incineration could be solidified easily to be a stable solid body with an inorganic solidifier such as cement, cement glass, and the like.

In accordance with the present embodiment, laundry with water was performed and the volume of the exhausted radioactive laundry waste water could be reduced.

Embodiment 2

The same procedure of concentration, drying, incineration, and solidifying as far as the above embodiment 1 were performed for testing with detergents of various composition. As for the inorganic builder, salts of hydrochloric acid, sulfuric acid, carbonic acid, nitric acid, or aluminosilicic acid were used for the testing.

The same results as for the embodiment 1 were obtained without any problem.

Embodiment 3

The dried powder obtained by the same method as the above embodiment 1 except without incineration was solidified by a conventional method with an inorganic solidifier such as cement, or cement glass. The obtained solid body had a mechanical strength of at least 150 kg/cm$^2$ and was stable. In view of volume-reduction, incinerating treatment is effective. However, solidifying directly with an inorganic solidifier does not cause any special problem.

Embodiment 4

Another embodiment of the present invention is explained hereinafter.

When the amount of the laundry waste water is relatively small, the evaporating concentration process can be skipped, and the laundry waste water can be concentrated and dried directly by a centrifugal thin film dryer.

In the present embodiment, the same simulated laundry waste water as the one used in the embodiment 1 was poured directly into the centrifugal thin film dryer. As a result, dried powder having a water content of at most 5% was generated continuously, and a problem of foaming did not occur. The laundry waste water could be treated safely by solidifying the dried powder directly or after incinerating with cement or cement glass.

Embodiment 5

Figure 3:
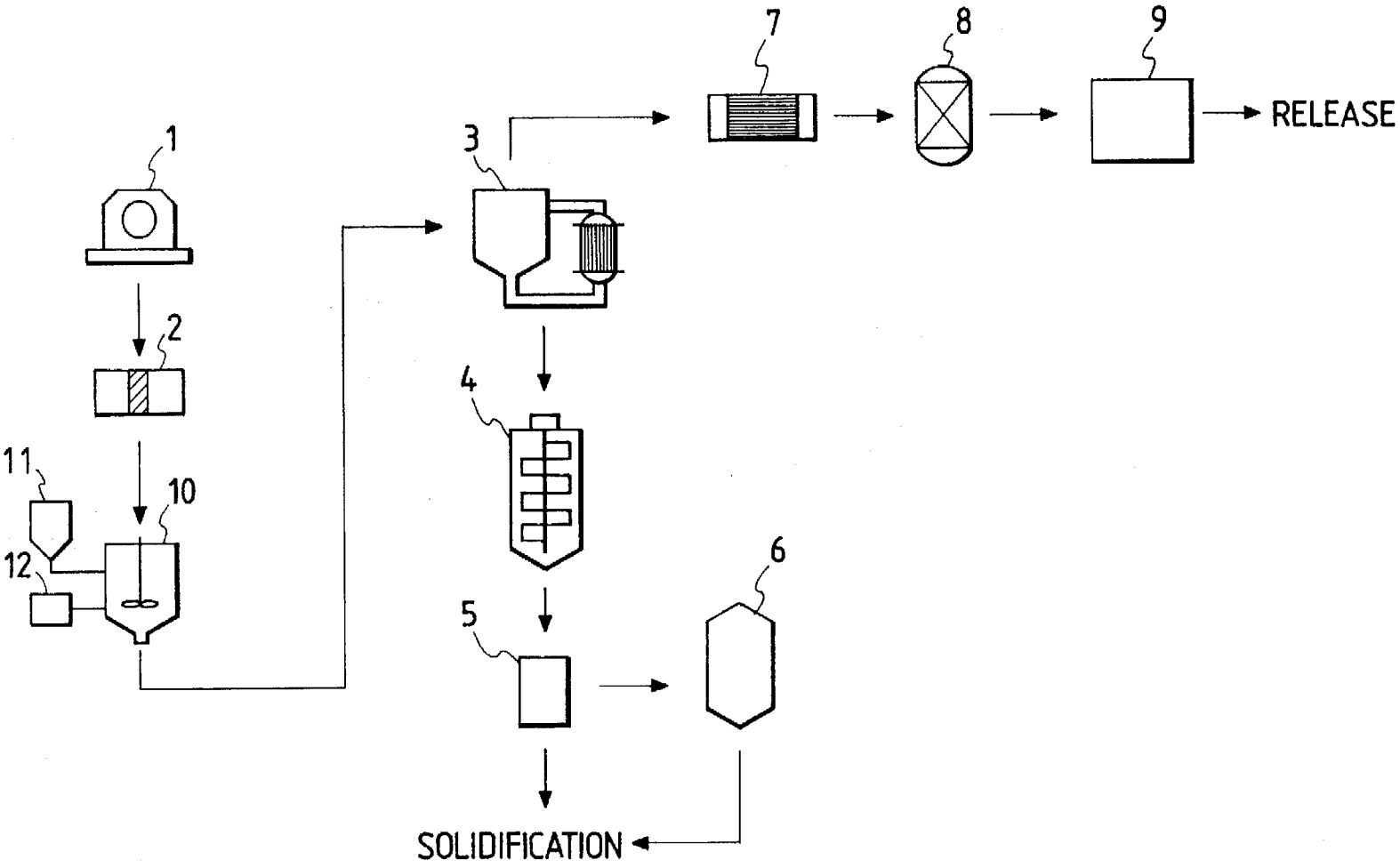
FIG. 3 is a flow diagram illustrating another embodiment of the present invention.

Further, another embodiment of the present invention is explained referring to FIG. 3.

FIG. 3 indicates a flow diagram of a case when composition and contents of a detergent in laundry waste water are unknown or uncertain by mixing or any other unknown reason. The laundry waste water exhausted from a washer 1 is transferred to an adjusting tank 10 after coarse insoluble components are eliminated by a filter 2. At the adjusting tank 10, a part of the waste water is taken as an analytical sample and the sample is analyzed by an analyzing apparatus 12 for determining contents of nonionic surface active agents and inorganic builders in the waste water.

When the contents of the inorganic builders are in a range of 300–800 parts by weight to 100 parts by weight of the nonionic surface active agent in the waste water, which is the preferable ratio of the inorganic builder to the nonionic surface active agent, the waste water is transferred directly to the concentrator 3.

When the contents of the inorganic builders are less than 300 parts by weight to 100 parts by weight of the nonionic surface active agent in the waste water, additional inorganic builder is added to the waste water from an inorganic builder storage tank 11 and stirred to dissolve the inorganic builder in the waste water for adjusting the ratio of the inorganic builder to the nonionic surface active agent to be in a range of the above preferable ratio. Subsequently, the waste water is transferred to the concentrator 3.

When the contents of the inorganic builders are more than 800 parts by weight to 100 parts by weight of the nonionic surface active agent in the waste water, the waste water is transferred directly to the concentrator 3. However, at the incinerating process of the dried powder, the incinerating temperature is lowered down to a temperature which does not melt the dried powder in consideration of kinds and contents of the contained inorganic builder in the dried powder.

The operation after the concentrator 3 was the same as far the embodiment 1, and a preferable solid body like that of the embodiment 1 could be obtained.

Embodiment 6

Furthermore, another embodiment of the present invention is explained referring to FIG. 3.

FIG. 3 indicates a flow diagram of a case when laundry waste water containing a detergent which does not use an inorganic builder but which use only a surface active agent is treated with the present invention. The laundry waste water exhausted from a washer 1 is transferred to an adjusting tank 10 after coarse insoluble components are eliminated by a filter 2. At the adjusting tank 10, a part of the waste water is taken as an analytical sample and the sample is analyzed by an analyzing apparatus 12 for determining contents of nonionic surface active agents in the waste water.

Subsequently, an inorganic builder is added to the waste water from an inorganic builder storage tank 11 and stirred to dissolve the inorganic builder in the waste water for adjusting the ratio of the inorganic builder to the nonionic surface active agent to be in a range of the above preferable ratio. Then, the waste water is transferred to the concentrator 3.

The operation after the concentrator 3 was the same as for the embodiment 1, and a preferable solid body like that of the embodiment 1 could be obtained.

What is claimed is:

1. A method for treating radioactive waste water containing a detergent primarily containing a nonionic surface active agent, comprising the steps of:

concentrating the waste water using an evaporating concentrator to obtain concentrated waste water;

pulverizing said concentrated waste water to obtain dried powder using a rotary centrifugal thin film dryer having a heater;

incinerating said dried powder in an incinerator to obtain incinerated residual; and solidifying said incinerated residual generated from the incinerator with an inorganic solidifier;

wherein said waste water contains an inorganic builder.

2. A method for treating radioactive waste water as claimed in claim 1, wherein said detergent includes polyoxyethylene derivatives 10–30% by weight, any one or any mixture of inorganic salt of hydrochloric acid, sulfuric acid, carbonic acid, nitric acid, and aluminosilicic acid 60–90% by weight, a small amount of re-combining inhibitor, a fluorescent agent, an enzyme, and a chelating agent.

3. A method for treating radioactive waste water as claimed in claim 1, wherein the heating temperature of said rotary centrifugal thin film dryer is kept lower than a melting point of said nonionic surface active agent during said pulverizing process of said concentrated waste water by said rotary centrifugal thin film dryer.

4. A method for treating radioactive waste water as claimed in claim 1, wherein both said detergent and said inorganic builder are added to said radioactive waste water.

5. A method for treating radioactive waste water containing a nonionic surface active agent and an inorganic builder, comprising the steps of:

adjusting firstly the content rate of said inorganic builder to said nonionic surface active agent by adding said inorganic builder so as to be in a range that said inorganic builder is 300–800 parts by weight to 100 parts by weight of said nonionic surface active agent, concentrating the waste water using an evaporating concentrator to obtain concentrated waste water, pulverizing said concentrated waste water to obtain dried powder using a rotary centrifugal thin film dryer having a heater, incinerating said dried powder in an incinerator to obtain incinerated residual, and solidifying said incinerated residual generated from the incinerator with an inorganic solidifier.

6. A method for treating radioactive waste water containing a nonionic surface active agent, comprising the steps of:

analyzing said waste water for determining content of said nonionic surface active agent in said waste water, adding inorganic builders for adjusting the content rate of said inorganic builder to said nonionic surface active agent to be in a range that said inorganic builder is 300–800 parts by weight to 100 parts by weight of said nonionic surface active agent, concentrating the waste water using an evaporating concentrator to obtain concentrated waste water, pulverizing said concentrated waste water to obtain dried powder by a rotary centrifugal thin film dryer having a heater, incinerating said dried powder in an incinerator to obtain incinerated residual, and solidifying said incinerated residual generated from the incinerator with an inorganic solidifier.

7. A method for treating radioactive waste water as claimed in claim 1, wherein the inorganic builder includes a zeolite.

8. A method for treating radioactive waste water as claimed in claim 1, wherein the inorganic builder includes a salt.

9. A method for treating radioactive waste water as claimed in claim 5, wherein the inorganic builder includes a zeolite.

10. A method for treating radioactive waste water as claimed in claim 5, wherein the inorganic builder includes a salt.

11. A method for treating radioactive waste water as claimed in claim 6, wherein the inorganic builder includes a zeolite.

12. A method for treating radioactive waste water as claimed in claim 6, wherein the inorganic builder includes a salt.

* * * * *